US007093467B2

(12) United States Patent
Kim et al.

(10) Patent No.: US 7,093,467 B2
(45) Date of Patent: Aug. 22, 2006

(54) WASHING MACHINE HAVING DETERGENT SUPPLY APPARATUS

(75) Inventors: Young-Ki Kim, Suwon (KR); Jae-Myong Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 431 days.

(21) Appl. No.: 10/224,555

(22) Filed: Aug. 21, 2002

(65) Prior Publication Data

US 2003/0172690 A1 Sep. 18, 2003

(30) Foreign Application Priority Data

Mar. 14, 2002 (KR) ..... 2002-13840

(51) Int. Cl.
*D06F 39/02* (2006.01)

(52) U.S. Cl. ..... 68/17 R; 134/93; 222/132

(58) Field of Classification Search ..... 68/17 R; 134/93; 222/129, 132
See application file for complete search history.

(56) References Cited

U.S. PATENT DOCUMENTS 3,975,931 A 8/1976 Bischkopf
6,167,733 B1 1/2001 Lee
6,865,911 B1 * 3/2005 Bolduan et al. ..... 68/17 R

FOREIGN PATENT DOCUMENTS

DE 36 07 632 9/1987
DE 37 15 832 11/1988
EP 0 247 686 12/1987
EP 1449951 A1 * 8/2004

OTHER PUBLICATIONS

Electronic translation of DE 3607632.*

* cited by examiner

*Primary Examiner*—Joseph L. Perrin
(74) *Attorney, Agent, or Firm*—Staas & Halsey LLP

(57) ABSTRACT

A washing machine includes a detergent supply apparatus having a detachable partition member. The detergent supply apparatus includes a casing which defines an outer appearance of the detergent supply apparatus, and a detergent/fabric softener container slidably set in the casing. The detergent/fabric softener container includes a fixed partition member which partitions the detergent/fabric softener container into a detergent chamber and a fabric softener chamber, and the detachable partition member is removably mounted in the detergent chamber, so as to partition the detergent chamber into a secondary detergent storing section and a main detergent storing section. The detergent chamber is entirely used as the main detergent storing section in response to removal of the detachable partition member from the detergent chamber.

7 Claims, 8 Drawing Sheets

WASHING MACHINE HAVING DETERGENT SUPPLY APPARATUS

CROSS-REFERENCE TO RELATED APPLICATIONS

This application claims the benefit of Korean Patent Application No. 2002-13840 filed on Mar. 14, 2002, in the Korean Industrial Property Office, the disclosure of which is incorporated herein by reference.

BACKGROUND OF THE INVENTION

1. Field of the Invention

The present invention relates to a washing machine, and more particularly, to a washing machine having a detergent supply apparatus which includes a detachable partition member removably mounted in a detergent chamber, so as to partition the detergent chamber into a main detergent storing section and a secondary detergent storing section, wherein the detergent chamber is used as the main detergent storing section in response to removal of the detachable partition member from the detergent chamber.

2. Description of the Related Art

Generally, washing machines are used to wash laundry by rotating a cylindrical rotary tub containing the laundry and wash water therein. Such washing machines have been typically classified into drum type washing machines and vertical shaft type washing machines. The drum type washing machines are designed such that a rotary tub is horizontally set in a housing and is rotated around a horizontal axis of the housing in opposite directions. Such actions repeatedly move the laundry seated on an internal surface of the rotary tub upward and allow the laundry to be dropped from the top to the bottom of the rotary tub to wash the laundry. In the vertical shaft type washing machines, a rotary tub with a pulsator is vertically set in a housing and is rotated around a vertical axis of the housing in opposite directions. Accordingly, laundry inside the rotary tub is washed by forced water currents generated by the pulsator.

FIG. 1 shows the construction of a drum type washing machine having a conventional detergent supply apparatus. The drum type washing machine includes a housing 1 which defines an outer appearance of the drum type washing machine. A water tub 9 having a drum shape is set in the housing 1 to contain wash water therein. A rotary tub 11 having a drum shape is rotatably set in the water tub 9 to wash laundry.

The water tub 9 is suspended in the housing 1 by suspension rods (not shown) and shock absorbers (not shown). An opening is formed on a front wall of the rotary tub 11 so as to place and remove the laundry from the rotary tub 11. The rotary tub 11 is perforated on its sidewall to have spin-drying perforations 11*a*. Furthermore, lifters 11 b are positioned on an internal surface of the rotary tub 11 at regular intervals. The lifters 11*b* are used to repeatedly move the laundry seated on the internal surface of the tub 11 upward and drop the laundry from the top to the bottom inside the rotary tub 11 to wash the laundry. The lifters 11*b* move in response to the rotary tub 11 being rotated by a drive motor 12 installed on a bottom wall of the housing 1.

A front door 13 is mounted to a front wall of the housing 1 to selectively close the opening of the rotary tub 11. A drain pump 14, a drain hose 15 and a filter 16 are installed at a bottom wall of the housing 1, and are used to discharge the wash water to the outside.

A cold water supply valve 7 and a hot water supply valve 8 are provided on an upper portion of the housing 1, and are connected to corresponding external water supply sources. The washing machine also has a conventional detergent supply apparatus 20. This detergent supply apparatus 20 selectively mixes a detergent or a fabric softener with the wash water fed through the cold and hot water supply valves 7 and 8, and then supplies the mixed wash water to the water tub 9.

FIG. 2 shows the construction of the conventional detergent supply apparatus 20. The conventional detergent supply apparatus 20 comprises a casing 21 having a box shape which is open at its front and top portions. A detergent/fabric softener container 22 is set in the casing 21. A water supply cover 23 covers the open top portion of the casing 21, and is connected to the cold and hot water supply valves 7 and 8 (see FIG. 1).

The casing 21 is inclined at its bottom to form a funnel shape. A wash water outlet 21*a* is formed at a lowermost portion of the funnel-shaped bottom to feed the wash water mixed with the detergent or the fabric softener to the water tub 9.

The detergent/fabric softener container 22 is open at its top and rear portions, and slidably installed in the casing 21. The detergent/fabric softener container 22 can move forward through the open front portion of the casing 21 so as to install the detergent/fabric softener container 22 replenished with the detergent and/or the fabric softener.

The detergent/fabric softener container 22 is partitioned into a secondary detergent storing chamber 26, a main detergent storing chamber 27, and a fabric softener storing chamber 28 by two partition walls 22*a* and 22*b*. In this case, the secondary detergent storing chamber 26 contains the detergent used for preliminary washing, while the main detergent storing chamber 27 contains the detergent used for main washing. The fabric softener storing chamber 28 contains the fabric softener used to rinse the laundry after washing the laundry. The open rear portion (not shown) of the detergent/fabric softener container 22 is spaced apart from a rear wall of the casing 21, and allows the wash water to flow to the wash water outlet 21*a* of the casing 21 from the storing chambers 26, 27, and 28 of the detergent/fabric softener container 22.

A siphon 29 is mounted to a bottom wall of the fabric softener storing chamber 28, so as to rapidly drain the wash water mixed with the fabric softener.

The water supply cover 23 covers the top portion of the casing 21, and is spaced apart from the detergent/fabric softener container 22 by a predetermined distance. The water supply cover 23 is provided with water supply chambers 26*a*, 27*a*, and 28*a* which correspond to the storing chambers 26, 27 and 28, respectively. A plurality of drain holes 24 are formed on a bottom wall of each of the water supply chambers 26*a*, 27*a*, and 28*a*, to supply the wash water contained in the water supply chambers 26*a*, 27*a*, and 28*a* to the storing chambers 26, 27, and 28.

As described above, the conventional detergent supply apparatus 20 is designed with two fixed partition walls 22*a* and 22*b* that are integrally formed in the detergent/fabric softener container 22 to provide the storing chambers 26, 27 and 28. The fabric softener storing chamber 28 is positioned between the secondary detergent storing chamber 26 and the main detergent storing chamber 27. Accordingly, the secondary detergent storing chamber 26 and the main detergent storing chamber 27 are invariable in their interior capacity.

However, a large quantity of detergent may be needed to wash laundry in an area where the quality of water is poor.

In other times, a user may wish to place a large quantity of detergent in the washing machine to get the laundry clean. Nevertheless, since the conventional detergent supply apparatus 20 is designed such that its secondary detergent storing chamber 26 and the main detergent storing chamber 27 each have a fixed capacity, it is impossible to contain a quantity of detergent exceeding the fixed capacity.

In such a case, the user has to add the additional detergent in the washing machine during its operation, or a washing operation has to be repeated several times. An additional washing operation, in turn, requires use of additional wash water. Therefore, the conventional detergent supply apparatus 20 is not user friendly and may require an additional consumption of the wash water.

The sizes of the secondary and main detergent storing chambers 26 and 27 may be enlarged to accommodate sufficient quantities of detergent therein. However, with the enlargement of the storing chambers 26 and 27, the overall size of the detergent supply apparatus 20 is also increased, resulting in an increase in the scale of the washing machine and an increase in the manufacturing cost of the washing machine. With such a washing machine, a large space is also required to install the washing machine, and installation of a large washing machine is difficult.

On the other hand, the secondary detergent storing chamber 26 may be omitted to increase the size of the main detergent storing chamber 27 without increasing the overall size of the detergent supply apparatus 20. However, in the case of washing excessively dirty or oily laundry, the preliminary washing as well as the main washing cannot be carried out with a single operation of the washing machine. In such a case, the detergent must be added to the washing machine twice, for both the preliminary washing and the main washing, making it inconvenient for a user to wash the laundry.

SUMMARY OF THE INVENTION

Accordingly, it is an object of the present invention is to provide a washing machine comprising a detergent supply apparatus having a detachable partition member removably mounted in a detergent chamber therein, so as to partition the detergent chamber to include a secondary detergent storing section and a main detergent storing section in response to the detachable partition member being set in the detergent chamber, and otherwise, the detergent chamber is used as the main detergent storing section in response to the detachable partition member being removed from the detergent chamber.

Additional objects and advantages of the invention will be set forth in part in the description which follows and, in part, will be obvious from the description, or may be learned by practice of the invention.

To achieve the above and other objects of the present invention, there is provided a washing machine comprising a housing which defines an outer appearance of the washing machine, a tub to receive laundry therein, and a detergent supply apparatus, wherein the detergent supply apparatus comprises a casing which defines an outer appearance of the detergent supply apparatus, a detergent/fabric softener container slidably set in the casing, a fixed partition member which partitions the detergent/fabric softener container into a detergent chamber and a fabric softener chamber, and a detachable partition member detachably mounted in the detergent chamber so as to partition the detergent chamber to include a secondary detergent storing section and a main detergent storing section, wherein the detergent chamber is used as the main detergent storing section in response to removal of the detachable partition member from the detergent chamber.

According to an aspect of the present invention, the detergent/fabric softener container is made of a flexible material, and the detachable partition member has a plate shape of a predetermined thickness, wherein the detachable partition member is detachably and vertically set in the detergent chamber of the detergent/fabric softener container.

According to another aspect of the present invention, the detachable partition member has a plate shape of a predetermined thickness, and the detergent chamber includes a holding unit provided on an interior bottom surface of the detergent chamber to removably hold the detachable partition member. The holding unit may be provided on each of the front and rear ends of the interior bottom surface of the detergent chamber. The holding unit comprises two projecting ribs spaced apart from each other at a regular interval to form a holding slit, wherein the detachable partition member is detachably inserted and held in the holding slit.

According to yet another aspect of the present invention, the detachable partition member comprises two sidewalls having a distance therebetween, and a bottom wall which connects the two sidewalls and is detachably seated on an interior bottom surface of the detergent chamber.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
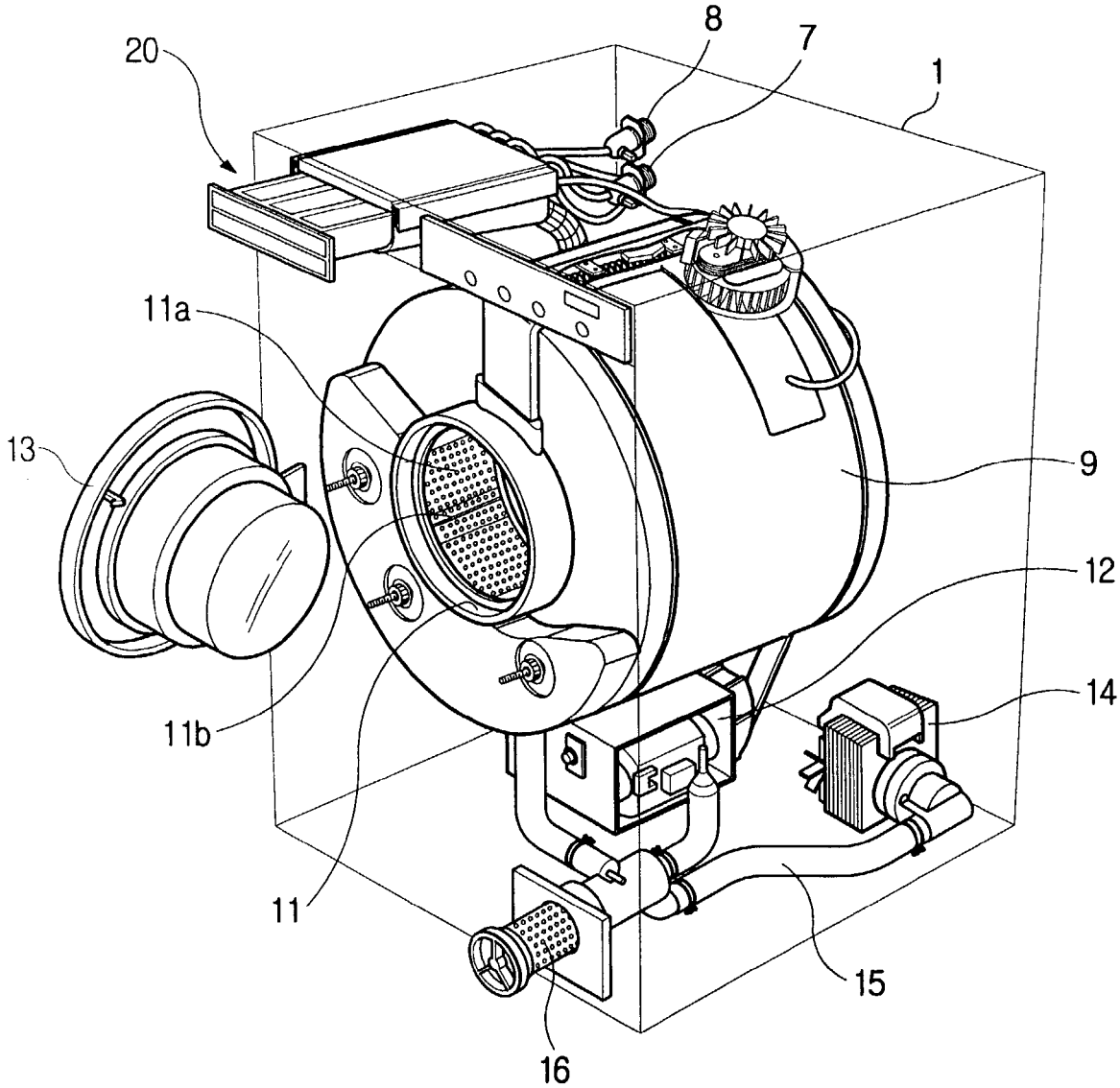
FIG. 1 (PRIOR ART)
FIG. 1 is a perspective view of an internal structure of a drum type washing machine having a conventional detergent supply apparatus.
Figure 2:
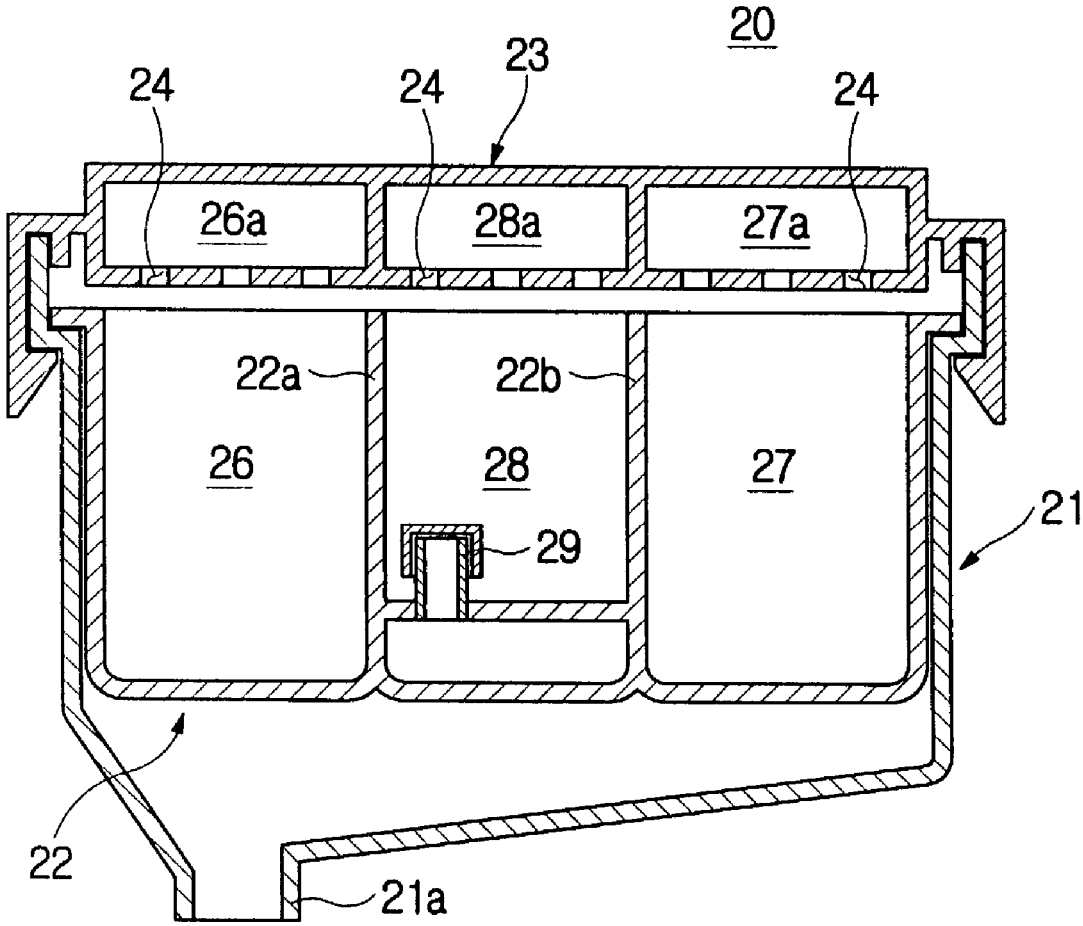
FIG. 2 (PRIOR ART)
FIG. 2 is a sectional view of the conventional detergent supply apparatus shown in FIG. 1.

Reference will now be made in detail to the embodiments of the present invention, examples of which are illustrated in the accompanying drawings, wherein like reference numerals refer to the like elements throughout. The embodiments are described below in order to explain the present invention by referring to the figures.

A detergent supply apparatus of the present invention can be applied to both drum type washing machines and vertical shaft type washing machines. As an example, a drum type washing machine having the detergent supply apparatus of the present invention is described below.

The drum type washing machine of the present invention has the same structure as that of the conventional drum type washing machine shown in FIG. 1 except for a detergent supply apparatus, so the common elements of this invention except for the detergent supply apparatus will be described herein with reference to FIG. 1.

Figure 3:
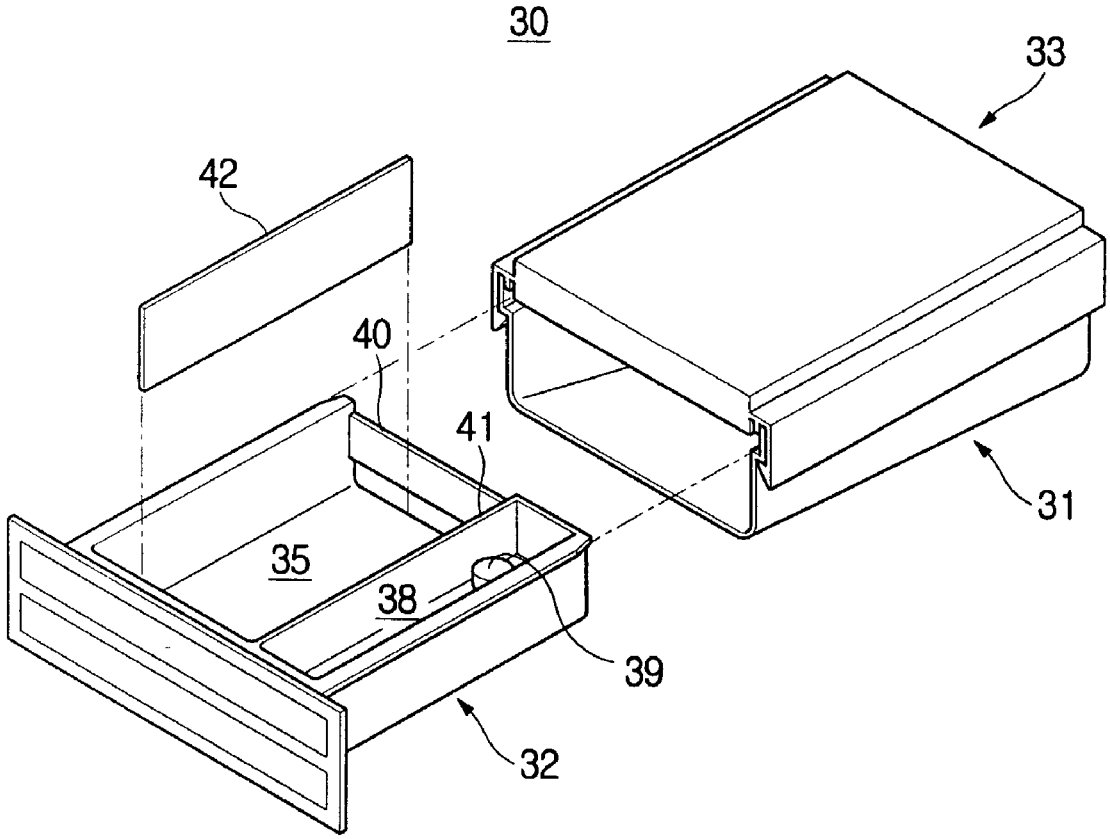
FIG. 3 is a perspective view showing a detergent supply apparatus, which supplies detergent to a washing machine, according to an embodiment of the present invention.
Figure 4:
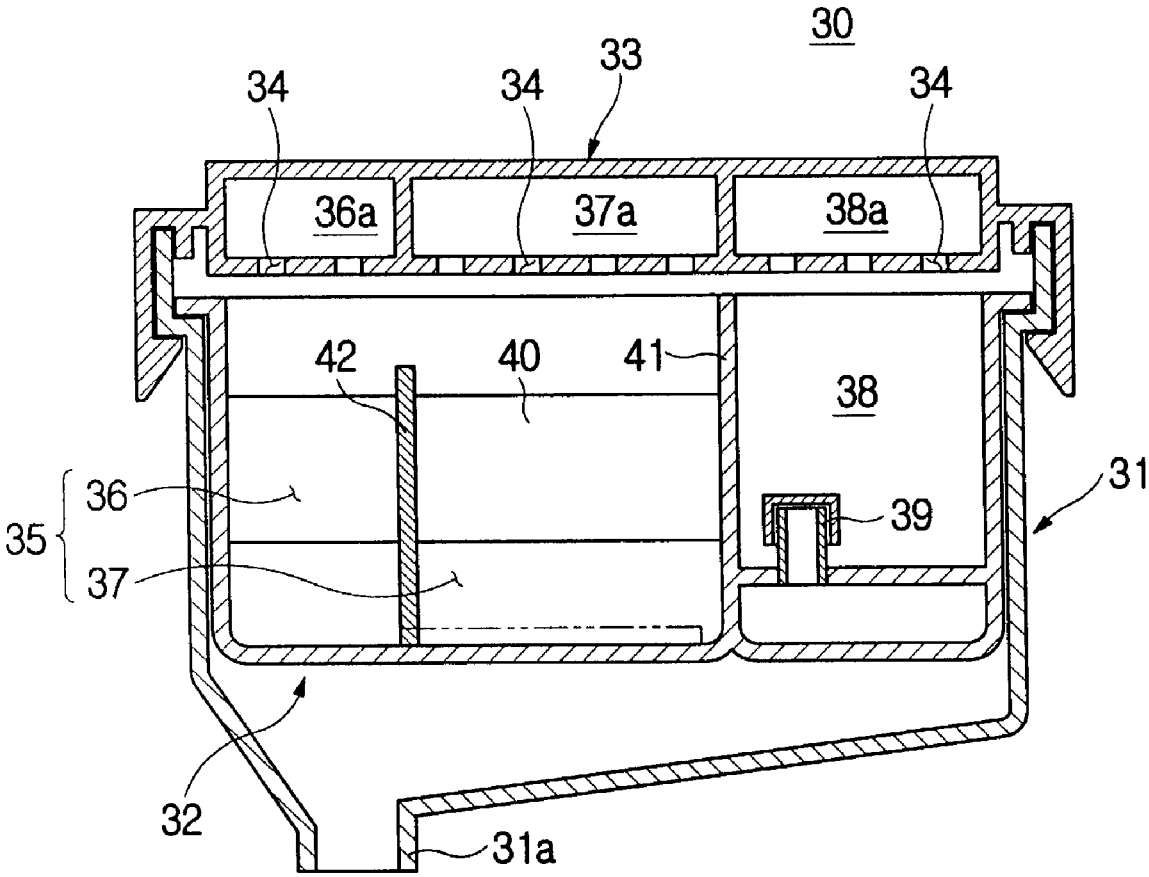
FIG. 4 is a sectional view of the detergent supply apparatus of FIG. 3.

FIGS. 3 and 4 show a detergent supply apparatus according to an embodiment of the present invention. FIG. 3 shows a perspective view of the detergent supply apparatus 30, with a detachable partition member 42 removed from the detergent supply apparatus 30. FIG. 4 shows a sectional view of the detergent supply apparatus 30, with the detachable partition member 42 set in the detergent supply apparatus 30.

As shown in FIG. 3, the detergent supply apparatus 30 comprises a casing 31 open at its front and upper portions. A detergent/fabric softener container 32 is slidably set in the casing 31. The detergent supply apparatus 30 further includes a water supply cover 33. The water supply cover 33 is placed on the top portion of the casing 31, and connected, at its rear wall, to the cold and hot water supply valves 7 and 8 (see FIG. 1)

The detergent/fabric softener container 32 is open at its upper and rear portions, wherein a detergent or a fabric softener is received through the open upper portion, and wash water mixed with the detergent or the fabric softener is discharged to the casing 31 through the open rear portion. To smoothly carry out such an operation, the rear end of the detergent/fabric softener container 32 is spaced apart from a rear wall of the casing 31 at a regular interval.

As shown in FIG. 4, the casing 31 is inclined at its bottom to form a funnel shape. A wash water outlet 31*a* is formed at a predetermined position on the bottom of the casing 31, to feed the wash water mixed with the detergent or the fabric softener to the water tub 9 (see FIG. 1).

Water supply chambers 36*a*, 37*a*, and 38*a* are provided in the water supply cover 33 to supply the wash water to the detergent/fabric softener container 32. Furthermore, drain holes 34 are formed on a bottom of each of the water supply chambers 36*a*, 37*a*, and 38*a* to supply the wash water to corresponding areas of the detergent/fabric softener container 32.

Referring back to FIG. 3, the detergent/fabric softener container 32 comprises a fixed partition member 41 and the detachable partition member 42. The fixed partition member 41 is vertically mounted in the detergent/fabric softener container 32, and partitions the container 32 into a detergent chamber 35 and a fabric softener chamber 38. In response to removably mounting the detachable partition member 42 in the detergent chamber 35, the detergent chamber 35 is partitioned into a plurality of storing sections.

Since the fixed partition member 41 is integrated with the detergent/fabric softener container 32, the fabric softener chamber 38 has a fixed capacity. The fabric softener chamber 38 supplies the fabric softener to the wash water in a rinsing operation of a main washing operation.

The detachable partition member 42 is removably mounted in the detergent chamber 35 to selectively partition the detergent chamber 35 into two sections or unite the two sections into one chamber. In this case, the detachable partition member 42 has a plate shape of a predetermined thickness, and is vertically set in the detergent/fabric softener container 32. To vertically set the detachable partition member 42 in the detergent/fabric softener container 32, the detergent/fabric softener container 32 is made of a flexible material, for example, a plastic.

A support member 40 links both side ends of the open rear portion of the detergent chamber 35 to each other, and is used to reinforce the detergent chamber 35 having a relatively long length, as well as to support a rear end of the detachable partition member 42. The support member 40 is placed at a position which is distant from a bottom wall of the detergent chamber 35 by a predetermined height, so as to have the wash water flow into the detergent chamber 35, mixed with the detergent, and be discharged to the casing 31.

Where a user fits the detachable partition member 42 in the detergent/fabric softener container 32 from the top to the bottom, the detergent/fabric softener container 32 and the support member 40 may slightly bulge outward. That is, where the detachable partition member 42 is fitted between a front wall of the container 32 and the support member 42, a front end of the detachable partition member 42 is in contact with an inner surface of the front wall of the container 32, while the rear end of the detachable partition member 42 is in contact with an inner surface of the support member 40. By upwardly pulling the detachable partition member 42, the detachable partition member 42 is easily removed from the detergent/fabric softener container 32.

Referring to FIG. 4, where the detachable partition member 42 is vertically set in the detergent chamber 35, the detergent chamber 35 is partitioned into a secondary detergent storing section 36 and a main detergent storing section 37. In this case, the secondary detergent storing section 36 is placed at a position corresponding to the water supply chamber 36*a* while the main detergent storing section 37 is placed at a position corresponding to the water supply chambers 37*a*.

With the detachable partition member 42 set in the detergent chamber 35 as shown in FIG. 4, the detergent can be separately supplied to the secondary detergent storing section 36 and the main detergent storing section 37. Accordingly, the washing machine is capable of performing the main washing operation using the wash water passed through the main detergent storing section 37, after performing a preliminary washing operation using the wash water passed through the secondary detergent storing section 36. Thus, the washing machine having the detergent supply apparatus of the present invention is operated in the same manner as a conventional washing machine which washes laundry twice, in the case of washing excessively dirty or oily laundry. However, in the present invention, detergent capacities of the corresponding washing operations can be changeably set by the user according to the position of the detachable partition member 42.

As shown in FIG. 3, where the detachable partition member 42 is removed from the detergent chamber 35, the detergent chamber 35 is used as the main detergent storing section 37. In this case, the capacity of the main detergent storing section 37 is increased to contain a large quantity of detergent therein. Therefore, in the case of washing laundry in an area where a quality of water is poor, or where a user desires to increase the detergent in the washing machine, the user may remove the detachable partition member 42 from the detergent chamber 35.

To remove the detachable partition member 42 from the detergent chamber 35, the user simply lifts up the detachable partition member 42, as shown in FIG. 3. However, the detachable partition member 42 may be designed to lie down on the bottom wall of the detergent/fabric softener container 32 as necessary, as shown by the two-dot chain line of FIG. 4. Such a construction allows the detachable partition member 42 to be easily kept in the detergent chamber 35 without degrading its original function.

The washing operation with respect to the detergent supply apparatus 30 having the structure as shown in FIGS. 3 and 4 will be described below.

In the case of washing excessively dirty or oily laundry, the washing machine may sequentially perform the preliminary washing operation and the main washing operation. To sequentially perform the preliminary washing and the main washing operations, the detachable partition member 42 is installed in the detergent chamber 35 to partition the chamber 35 into the secondary detergent storing section 36 and the main detergent storing section 37 (See FIG. 4).

First, a user may take out the detergent/fabric softener container 32 from the casing 31 by pulling forward the detergent/fabric softener container 32. Next, the user places adequate quantities of detergent in both the secondary detergent storing section 36 and the main detergent storing section 37 while placing an adequate quantity of the fabric softener in the fabric softener chamber 38. Thereafter, the user sets the detergent/fabric softener container 32 in the casing 31.

During an operation of the washing machine, wash water flows into the water supply chamber 36*a* from the cold water supply valve 7 or the hot water supply valve 8 (see FIG. 1), and drops into the secondary detergent storing section 36 through the drain holes 34. Next, the wash water is mixed with the detergent contained in the secondary detergent storing section 36, and then supplied to the water tub 9 through the wash water outlet 31*a* of the casing 31 (see FIG. 1). Thereafter, the washing machine sequentially performs a washing operation, a rinsing operation, and a draining operation of the preliminary washing operation. In this case, the washing machine is programmed not to use the fabric softener in the rinsing operation of the preliminary washing operation.

After the preliminary washing operation is completed, the main washing operation is carried out. At this time, the wash water flows into the water supply chamber 37*a*, and drops into the main detergent storing section 37 through the drain holes 34. Next, the wash water is mixed with the detergent in the main detergent storing section 37, and then supplied to the water tub 9 through the wash water outlet 31*a* of the casing 31. Where the wash water with the detergent is supplied to the water tub 9 to perform the main washing operation, the washing machine sequentially performs a washing operation, a rinsing operation, and a draining operation in the same manner as the preliminary washing operation, thus finishing the sequential washing operation.

In the rinsing operation of the main washing operation, the wash water flows into the fabric softener chamber 38 through the water supply chamber 38*a* and the drain holes 34, and is mixed with the fabric softener. The wash water with the fabric softener is fed to the water tub 9 by using a siphon 39 and the wash water outlet 31*a* of the casing 31 (see FIG. 4).

In the case where the laundry is not excessively dirty and there is no need to use the preliminary washing operation, but the quality of water is poor, or where a large quantity of detergent is desired by a user to get the laundry clean with a single washing operation, the user may remove the detachable partition member 42 from the detergent chamber 35 as shown in FIG. 3. Alternatively, the user may lay the detachable partition member 42 on the bottom wall of the detergent chamber 35, as shown by the two-dot chain line of FIG. 4, to use the detergent chamber 35 as the main detergent storing section 37.

After placing the detergent in the main detergent storing section 37 having an increased interior capacity and adding the fabric softener in the fabric softener chamber 38, the washing machine is operated. At this time, wash water flows into the main detergent storing section 37 through the water supply chamber 37*a* and the drain holes 34, and is mixed with the detergent. Next, the wash water flows into the water tub 9 through the wash water outlet 31*a* of the casing 31.

Where a predetermined quantity of the wash water with the detergent is contained in the water tub 9, a rotary tub 11 (see FIG. 1) is rotated to wash the laundry. During a rinsing operation, the wash water flows into the fabric softener chamber 38 through the water supply chamber 38*a*, and the wash water mixed with the fabric softener is fed to the water tub 9 to rinse the laundry. After the rinsing operation, the washing machine performs a draining operation to finish the single washing operation to wash the laundry.

As described above, with the entire detergent chamber 35 used as the main detergent storing section 37, the detergent chamber 35 can contain a large quantity of detergent. Thus, it is convenient to use the washing machine where the quality of water is poor, or where a user desires to place a large quantity of detergent in the washing machine.

Figure 5:
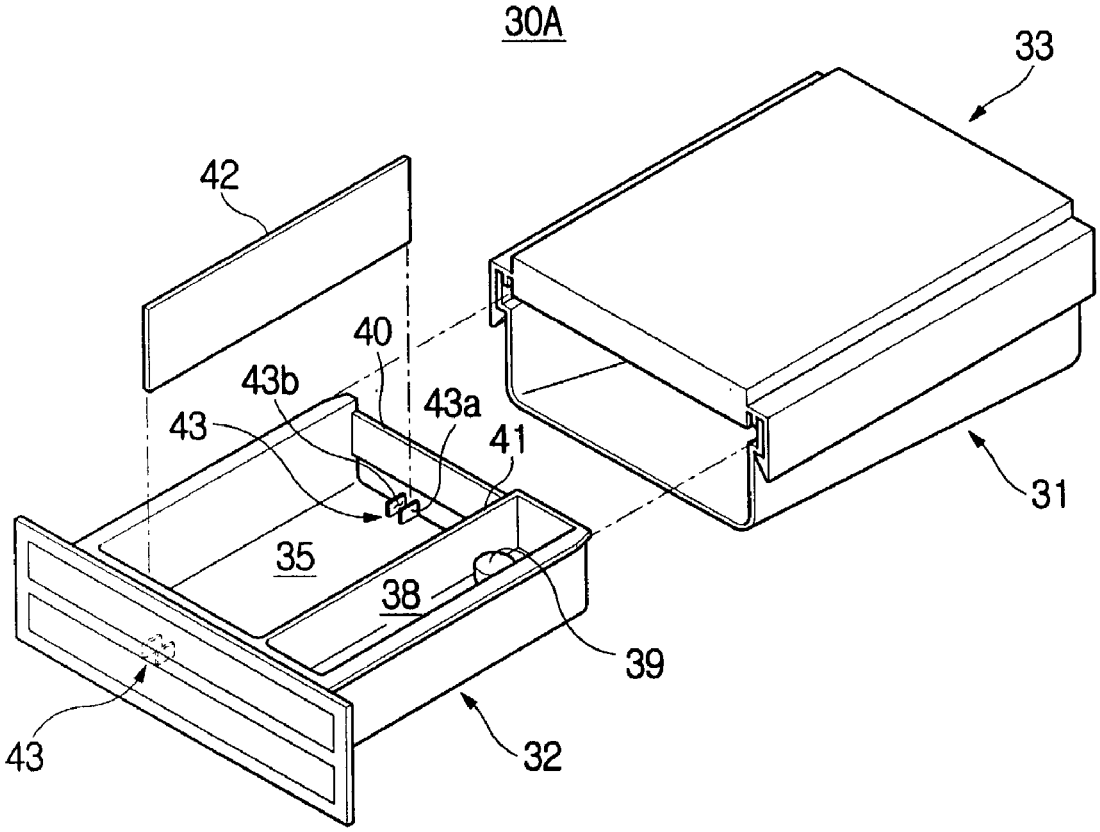
FIG. 5 is a perspective view of a detergent supply apparatus according to another embodiment of the present invention.
Figure 6:
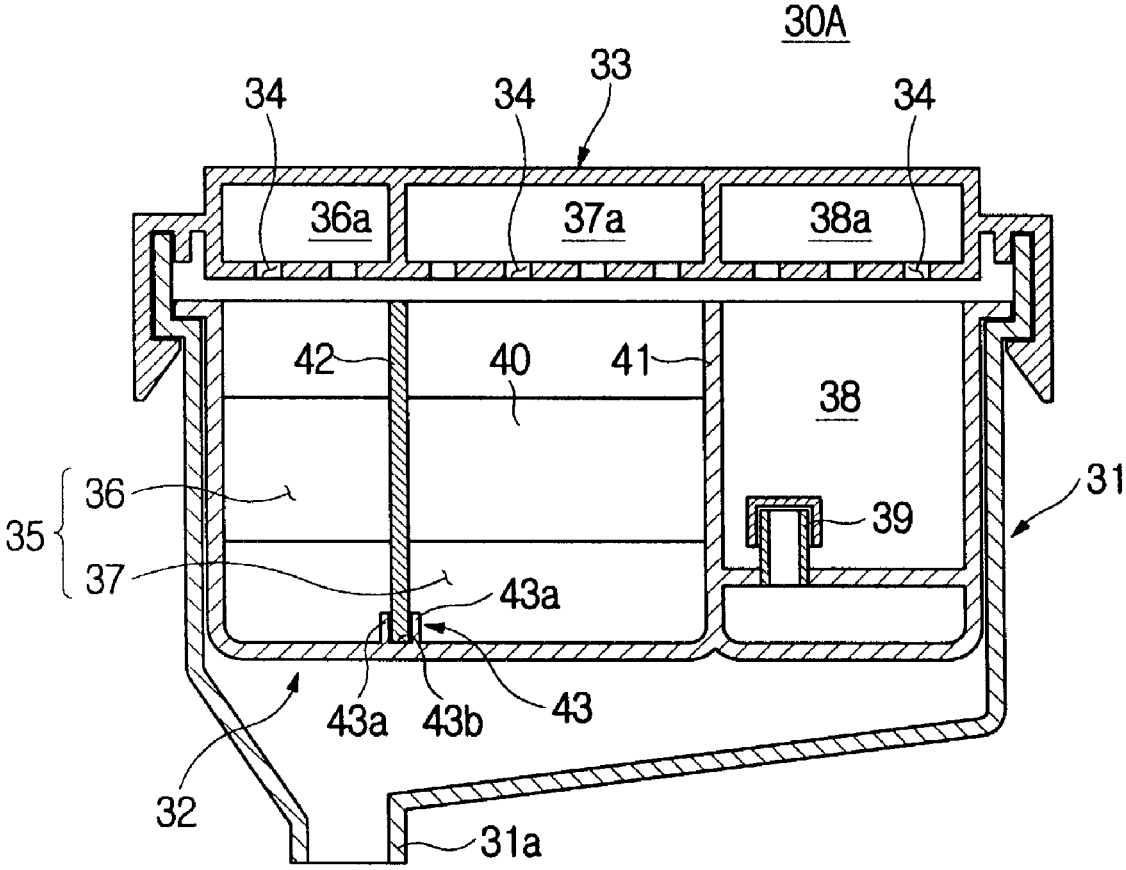
FIG. 6 is a sectional view of the detergent supply apparatus of FIG. 5.

FIGS. 5 and 6 show a detergent supply apparatus according to another embodiment of the present invention. FIG. 5 shows a perspective view of the detergent supply apparatus 30A, with a detachable partition member 42 removed from the detergent supply apparatus 30A. FIG. 6 shows a sectional view of the detergent supply apparatus 30A with the detachable partition member 42 set in the detergent supply apparatus 30A.

The construction of the detergent supply apparatus 30A of FIGS. 5 and 6 are the same as that shown in FIGS. 3 and 4, except a holding unit 43 which is provided on each of the front and rear ends of the detergent chamber 35. Accordingly, only the holding unit 43 will be described below.

Each of the holding units 43 is placed at a junction between the water supply chamber 36*a* and the water supply chamber 37*a* of the water supply cover 33. Each of the holding units 43 includes two projecting ribs 43*a* and a holding slit 43*b*. In this case, the two projecting ribs 43*a* are spaced apart from each other by a thickness of the detachable partition member 42 to form the holding slit 43*b*.

To partition the detergent chamber 35 into the secondary detergent storing section 36 and the main detergent storing section 37, as shown in FIG. 6, an end of the detachable partition member 42 is fitted into each of the holding slits 43*b* to be held by the projecting ribs 43*a*. Thus, the detachable partition member 42 is stably set in the detergent chamber 35. To use the detergent chamber 35 as the main detergent storing section 37, as shown in FIG. 5, the user may simply lift up the detachable partition member 42. At this time, the detachable partition member 42 is easily removed from the detergent chamber 35.

With the guide of the holding unit 43 in the detergent supply apparatus 30A, placement and removal of the detachable partition member 42 is more easily performed. Furthermore, it is not necessary to manufacture the detergent/fabric softener container 32 with a flexible material. The holding units 43 are provided on the front and rear ends of the detergent chamber 35. However, it is understood that they may be provided at other desired locations, and one or more additional holding units may be provided.

The washing operation with respect to the detergent supply apparatus 30A is the same as that of FIGS. 3 and 4, and therefore will not be repeated below.

Figure 7:
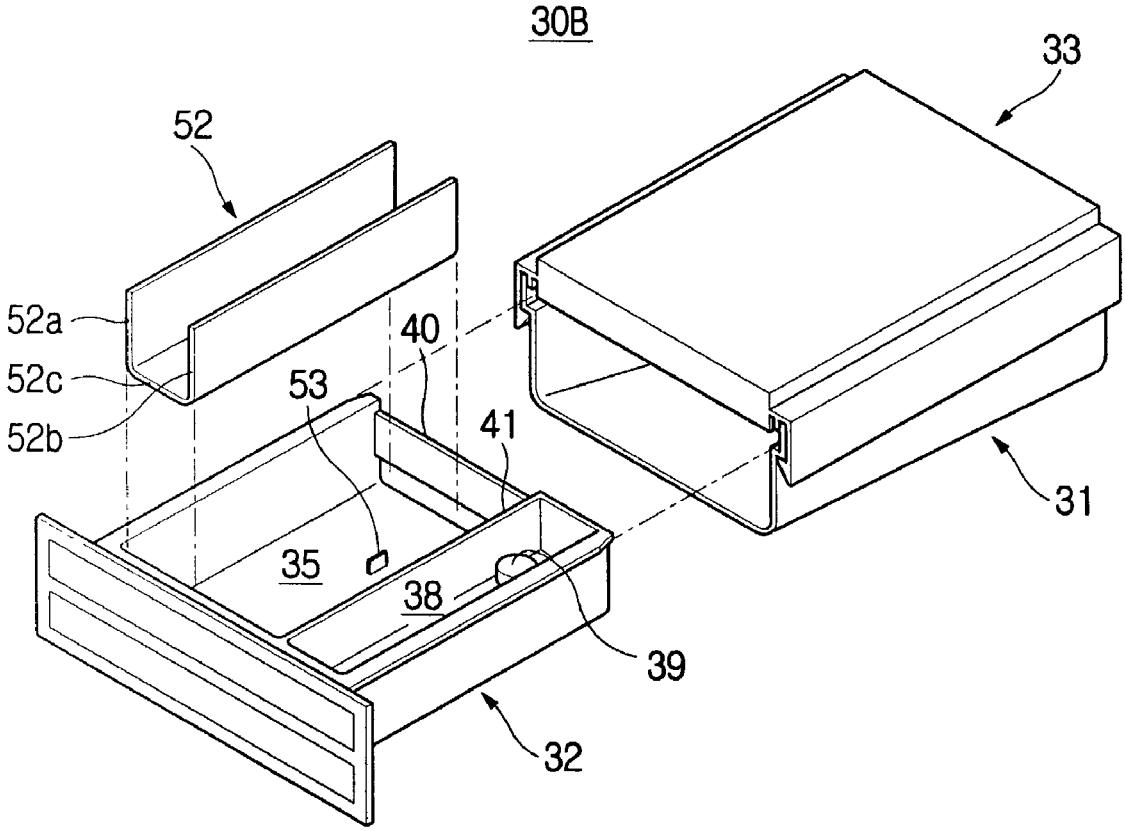
FIG. 7 is a perspective view of a detergent supply apparatus according to yet another embodiment of the present invention.
Figure 8:
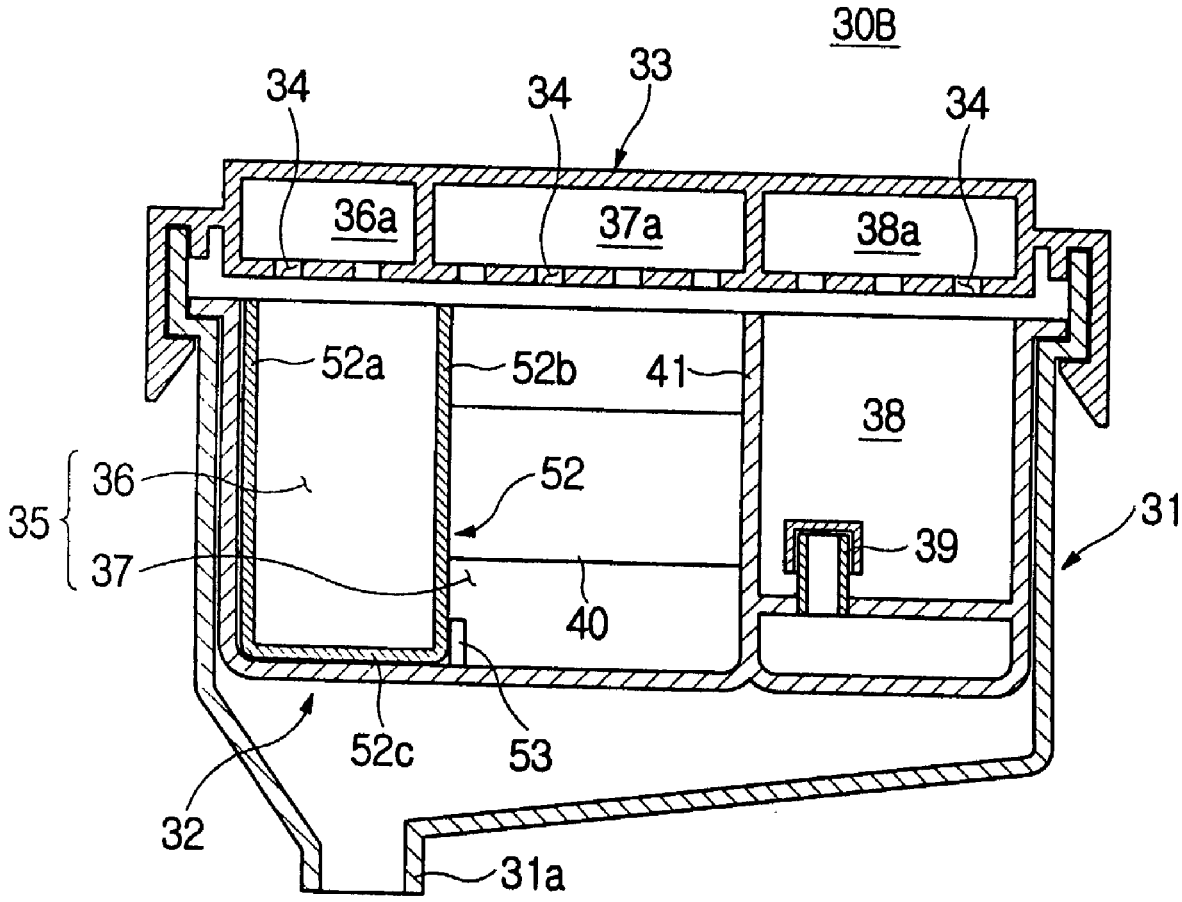
FIG. 8 is a sectional view of the detergent supply apparatus of FIG. 7.

FIGS. 7 and 8 show a detergent supply apparatus according to yet another embodiment of the present invention. FIG. 7 shows a perspective view of the detergent supply apparatus 30B, with a detachable partition member 52 removed from the detergent supply apparatus 30B. FIG. 8 shows a sectional view of the detergent supply apparatus 30B, with the detachable partition member 52 mounted in the detergent supply apparatus 30B.

As shown in FIGS. 7 and 8, the detachable partition member 52 includes two sidewalls 52*a* and 52*b* and a bottom wall 52*c* to have a channel-shape. Where the detachable partition member 52 is set in the detergent chamber 35, for example, a left-hand sidewall 52*a* of the detachable partition member 52 comes into contact with a left-hand sidewall of the detergent chamber 35, as shown in FIG. 8, and the detergent chamber 35 is easily partitioned into the secondary detergent storing section 36 and the main detergent storing section 37. At this time, the detachable partition member 52 itself forms the secondary detergent storing section 36 to store the detergent. The bottom wall 52*c* of the detachable partition member 52 is equal to or slightly wider than the water supply chamber 36*a* in its width.

To prevent an unexpected movement of the detachable partition member 52 set in the detergent chamber 35, a holding protrusion 53 may be formed on the bottom wall of the detergent chamber 35 so as to be upwardly protruded from the bottom wall of the detergent chamber 35 by a predetermined length. Where the detachable partition member 52 is set in the detergent chamber 35, a right-hand sidewall 52*b* of the detachable partition member 52 is held by the holding protrusion 53.

The construction of the detergent supply apparatus 30B of FIGS. 7 and 8 remains the same as those of FIGS. 3–4 and 5–6, except for the shape of the above-mentioned detachable partition member 52 and the holding protrusion 53. Accordingly, to avoid the repetition, further description of the detergent supply apparatus 30B is not presented.

As described above, the present invention provides a detergent supply apparatus having a detachable partition member which is removably set in a detergent chamber, so as to partition the detergent chamber into a secondary detergent storing section and a main detergent storing section in response to the detachable partition member being set in the detergent chamber. Otherwise, the detergent chamber is entirely used as the main detergent storing section in response to the detachable partition member being removed from the detergent chamber. Thus, in the case of washing laundry in an area where the quality of water is poor, or where an operator desires to use a large quantity of detergent in the washing machine, the operator may simply remove the detachable partition member from the detergent chamber to increase the interior capacity of the main detergent storing section. In addition, in the case of washing excessively dirty or oily laundry, the operator may set the detachable partition member in the detergent chamber to allow a separate detergent reservoir in the washing machine to perform main and preliminary washing operations.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A detergent supply apparatus which supplies detergent to a washing machine, comprising:

a casing which defines an outer appearance of the detergent supply apparatus;

a detergent/fabric softener container slidably set in the casing;

a fixed partition member which partitions the detergent/fabric softener container into a detergent chamber and a fabric softener chamber; and a detachable partition member detachably mounted in the detergent chamber so as to partition the detergent chamber to include a secondary detergent storing section and a main detergent storing section, wherein the detachable partition member comprises two sidewalls having a distance therebetween, and a bottom wall which connects the two sidewalls to form the secondary detergent storing section and is detachably seated on an interior bottom surface of the detergent chamber.

2. The detergent supply apparatus according to claim 1, wherein the detergent chamber includes a holding protrusion which removably holds the detachable partition member, and is formed at a position spaced from a sidewall of the detergent chamber by a width of the detachable partition member.

3. A washing machine comprising:

a housing which defines an outer appearance of the washing machine;

a tub provided in the housing to receive laundry therein; and a detergent supply apparatus, wherein the detergent supply apparatus comprises:

a casing which defines an outer appearance of the detergent supply apparatus, a detergent/fabric softener container slidably set in the casing, a fixed partition member which partitions the detergent/fabric softener container into a detergent chamber and a fabric softener chamber, and a detachable partition member detachably mounted in the detergent chamber so as to partition the detergent chamber to include a secondary detergent storing section and a main detergent storing section, wherein the detachable partition member comprises two sidewalls having a distance therebetween, and a bottom wall which connects the two sidewalls to form the secondary detergent storing section and is detachably seated on an interior bottom surface of the detergent chamber.

4. The washing machine according to claim 3, wherein the detergent chamber includes a holding protrusion which removably holds the detachable partition member, and is formed at a position spaced from a sidewall of the detergent chamber by a width of the detachable partition member.

5. The washing machine according to claim 3, wherein an inner channel area of the detachable partition member forms a section used as the secondary detergent storing section.

6. The washing machine according to claim 3, wherein the detergent supply apparatus further comprises a water supply cover which forms a top portion of the casing, and includes water supply chambers having drain holes which supply wash water to corresponding areas of the detergent/fabric softener container.

7. The washing machine according to claim 6, wherein:

the water supply chambers include first, second and third water supply chambers corresponding to the secondary detergent storing chamber, the main detergent storing chamber and the fabric softener chamber, and the inner channel area of detachable partition member has a width equal to or greater than that of the first water supply chamber.

* * * * *